US009669367B1

(12) United States Patent
Caughey

(10) Patent No.: US 9,669,367 B1
(45) Date of Patent: Jun. 6, 2017

(54) STIRRING MACHINE DOWN AUGER PROTECTION SYSTEM

(71) Applicant: Nebraska Engineering Co., Omaha, NE (US)

(72) Inventor: Aaron Caughey, Omaha, NE (US)

(73) Assignee: NEBRASKA ENGINEERING CO., Ohama, NE (US)

( * ) Notice: Subject to any disclaimer, the term of this patent is extended or adjusted under 35 U.S.C. 154(b) by 259 days.

(21) Appl. No.: 14/596,427

(22) Filed: Jan. 14, 2015

Related U.S. Application Data

(60) Provisional application No. 61/927,742, filed on Jan. 15, 2014.

(51) Int. Cl.
*B01F 13/00* (2006.01)
*B01F 13/04* (2006.01)

(52) U.S. Cl.
CPC ..... *B01F 13/045* (2013.01)

(58) Field of Classification Search
CPC ..... A01F 2025/2054; A01F 2025/2063; B01F 13/045
See application file for complete search history.

(56) References Cited

U.S. PATENT DOCUMENTS 6,206,073 B1 * 3/2001 Lay ..... A01F 25/2018 160/1

* cited by examiner

*Primary Examiner* — Tony G Soohoo
*Assistant Examiner* — Anshu Bhatia
(74) *Attorney, Agent, or Firm* — Milligan PC LLO

(57) ABSTRACT

An auger protection system used in a stirring system is disclosed. According to a first preferred embodiment, an auger protection system is provided which protects augers on a stirring machine from breaking or bending. Accordingly to this first preferred embodiment, the auger protection system includes a switch which is enclosed in a housing and connected to a timer which supplies power to a gear motor that propels the unit around a silo. Preferably, the housing for the holding switch is attached pivotally to the structure on which the down auger is connected. Additionally, the auger protection system preferably further includes a spring which is connected to a pivot assembly and which extends horizontally and comes in contact with the down auger at one end.

6 Claims, 2 Drawing Sheets

STIRRING MACHINE DOWN AUGER PROTECTION SYSTEM

RELATED APPLICATIONS

The present application claims priority to U.S. Provisional Application No. 61/927,742 filed Jan. 15, 2014.

FIELD OF INVENTION

The present disclosure is related in general to auger protection systems and, in particular to an auger protection system for stirring machines.

BACKGROUND OF THE INVENTION

Stirring machines are commonly subject to mechanical failures relating to the operation of their down augers. Most commonly, the down auger may fail and require maintenance as a result of down auger motor failure, pulley belt failure, and overloading due to wet grain conditions. As the augers travel around the bin, there will be some unavoidable trailing of the lower portion of the auger. However, when augers bend too far from the perpendicular, the force required to move the horizontal support member around the bin becomes magnified and the likelihood of structural failure is increased.

In the known prior art, an apparatus is disclosed which includes a wheeled carriage which moves radially and reciprocally with respect to a circular grain bin on its horizontal support member. Another existing apparatus discloses down augers which are joined directly to the horizontal support member and therefore, only move in a circular fashion about the bin. In both of these apparatuses, a motor separate from the down auger drive motor is responsible for the arcuate movement of the horizontal support member. Still another known apparatus employs a single source of motive power for both down auger rotation and the horizontal support member arcuate movement which includes a solenoid controlled release clutch for the drive responsible for the arcuate movement.

Another existing system in the prior art discloses a grain bin stirring apparatus which requires less force to initiate the arcuate movement of the horizontal support member when the rotation of the down augers has first commenced. According to this prior art, the higher the rate of revolution of the down augers before initiating the arcuate movement of the horizontal support member about the grain bin, the easier it is for the motor to overcome the resistance of the grain mass. As a result, there is less wear and tear and longer life of the associated parts if the arcuate movement is automatically delayed until the auger rotation first reaches a predetermined rate. In these devices, a sail switch controls the arcuate movement of the horizontal support member and the predetermined rate of revolution of the augers. However, this device is complex, having many moving parts which are easily subject to breakdown. These parts include a spring operated switch, a circular cover plate to hold the switch in the down/off position when the auger is not revolving at a sufficient rate, and a plurality of steel balls attached to arms which are again pivotally attached to the auger shaft. Most of these parts are themselves subject to breakdown or failure due to the accumulated dust, grime and bending.

Recent advancements in the prior art provide an auger protecting system in which augers are protected using a tilt switch. In this type of system, the tilt switch measures the angle of the down augers relative to vertical. The tilt switches are initially set and then adjusted in the field depending on the grain depth, type or quality. As with the other prior art discussed above, this system suffers a number of drawbacks. First, the tilt switch can only be adjusted once the grain bin is filled. Secondly, if the tilt switch is not correctly set, the down augers will bend and break. Thirdly, the tilt switch measures an angle that is not directly correlated to the stress in the down auger and does not provide information to set the switch to protect the augers.

Based on the foregoing, there is a need for a system that adequately prevents down augers from bending or breaking. Such a needed system would directly measure the force against the down augers using springs and the like. Further, the system would allow the calculation of maximum allowable force based on the characteristics of the down auger. The present embodiment overcomes prior art shortcoming by accomplishing these critical objectives.

SUMMARY OF THE DISCLOSURE

To minimize the limitations found in the prior art, and to minimize other limitations that will be apparent upon the reading of the specifications, the preferred embodiment of the present invention provides an auger protection system for stirring machines that provides a low maintenance and reliable system to protect augers from bending or breaking.

According to a first preferred embodiment, an auger protection system is provided which protects augers on a stirring machine from breaking or bending. Accordingly to this first preferred embodiment, the auger protection system includes a switch which is enclosed in a housing and connected to a timer which supplies power to a gear motor that propels the unit around a silo. In this embodiment, a down auger is connected to a supporting structure and extends downward to a grain bin. Preferably, the housing for the holding switch is attached pivotally to the structure on which the down auger is connected. Additionally, the auger protection system preferably further includes a spring which is connected to a pivot assembly and which extends horizontally and comes in contact with the down auger at one end.

According to a further preferred embodiment, the spring within the auger protection system of the present invention preferably measures and reacts to the resistance force pushing against the down auger. Preferably, the spring rate is known and is used for the calculation of maximum allowable force. In this configuration, the maximum allowable force can be calculated at the location of the spring based upon the characteristics of the down auger. When force is applied, the auger stretches (or compresses) the spring to a maximum allowable distance. When this maximum allowable distance is reached, the system causes a switch to shut off a gear motor. Accordingly, the system allows the augers to catch up in the grain and reduce the stress.

Preferably, the auger protection system of the present invention may be set at the time of assembly and/or manufacture and does not necessarily need to be adjusted after setting up. In use, the auger protection system is designed to provide a low maintenance and reliable system to protect down augers on a stirring machine from breaking or bending regardless of grain depth, type or quality.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
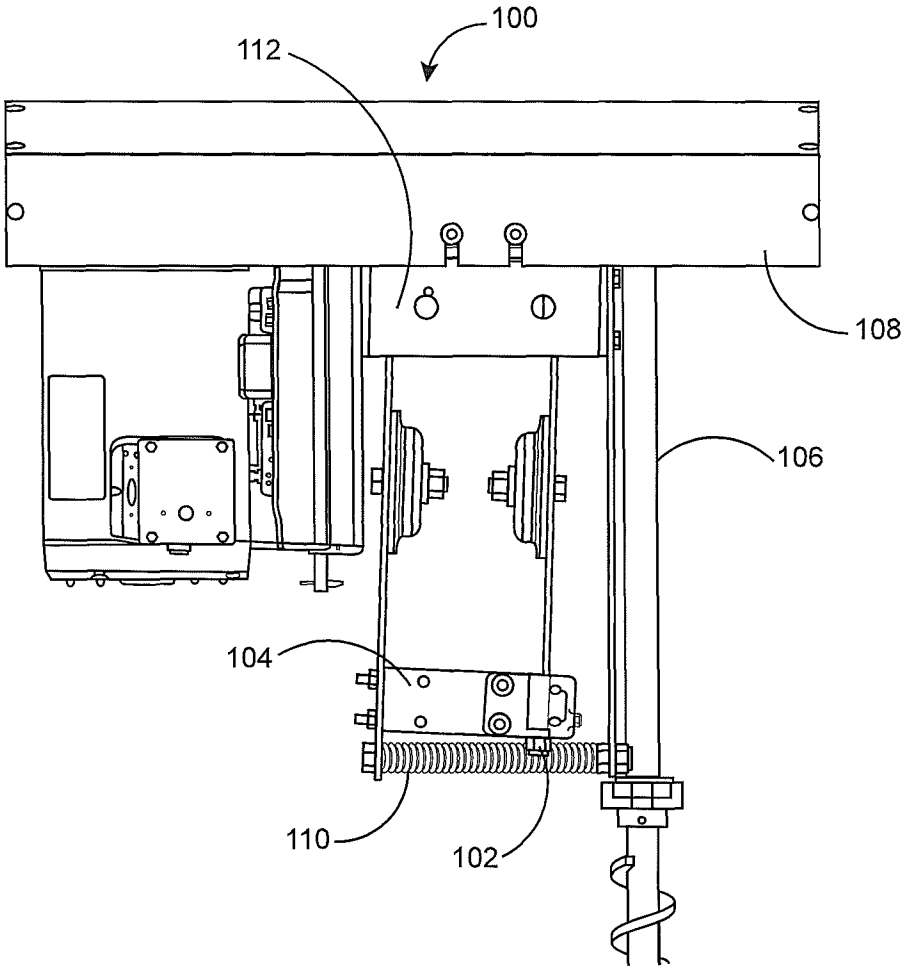
FIG. 1 is a schematic diagram of an auger protecting system for a stirring machine in accordance with a first preferred embodiment of the present invention.

FIG. 1 is a schematic diagram of an auger protecting system 100 for a stirring machine in accordance with a first preferred embodiment of the present invention. Preferably, the auger protection system 100 is utilized to protect down augers on a stirring machine from bending or breaking. As shown, the auger protection system 100 preferably includes a switch 102 which is enclosed in a housing 104 and a down auger 106 which is connected to a structure 108 and which extends downward to a grain bin. Preferably, the system 100 further includes a switch 102 enclosed in the housing 104 which is connected to a timer which supplies power to the gear motor that propels the unit around the silo. According to a further preferred embodiment, the housing 104 which holds the switch 102 is preferably attached pivotally to the structure 108 on which a down auger 106 is connected. As further shown, a spring 110 is preferably connected to a pivot assembly 112 which extends horizontally and connects to the down auger 106 at one end.

According to a preferred embodiment, the force against the down auger 106 is directly measured using a spring 110. Preferably, the spring rate is obtained and the force required to move the spring 110 to a desired distance is calculated. Thereafter, the maximum allowable force is determined at the location of the spring 110 as it is displaced by the bending/slowing force pushing against the down auger 106. A switch 102 is then preferably actuated by the spring 110 when the spring 110 is compressed to a maximum allowable distance which causes a reduction in the power supplied by the motor. According to a preferred embodiment, the switch 102 may alternatively shut off the motor for a specific amount of time when actuated. This allows the down auger 106 to catch up in the grain and reduce stress.

According to an alternative preferred embodiment, the motor may be configured to shut off at periodically determined intervals based on recording predetermined maximum allowable spring tensions over a given period of time. Further, in place of the spring 110, the force against the down auger 106 may alternatively be measured by any of a variety of displacement and/or tension measuring devices including: tension meters, tension transducers, fluid pressure transducers, load cells, displacement transducers and the like.

In use, the auger protecting system 100 protects the down auger 106 from breaking regardless of grain depth, type or quality. The auger protection system 100 is designed to provide a low maintenance and reliable system to protect the down auger 106 on a stirring machine from breaking or bending. The auger protection system 100 reduces the maintenance of stirring machines and does not need to be adjusted after setting up.

Figure 2:
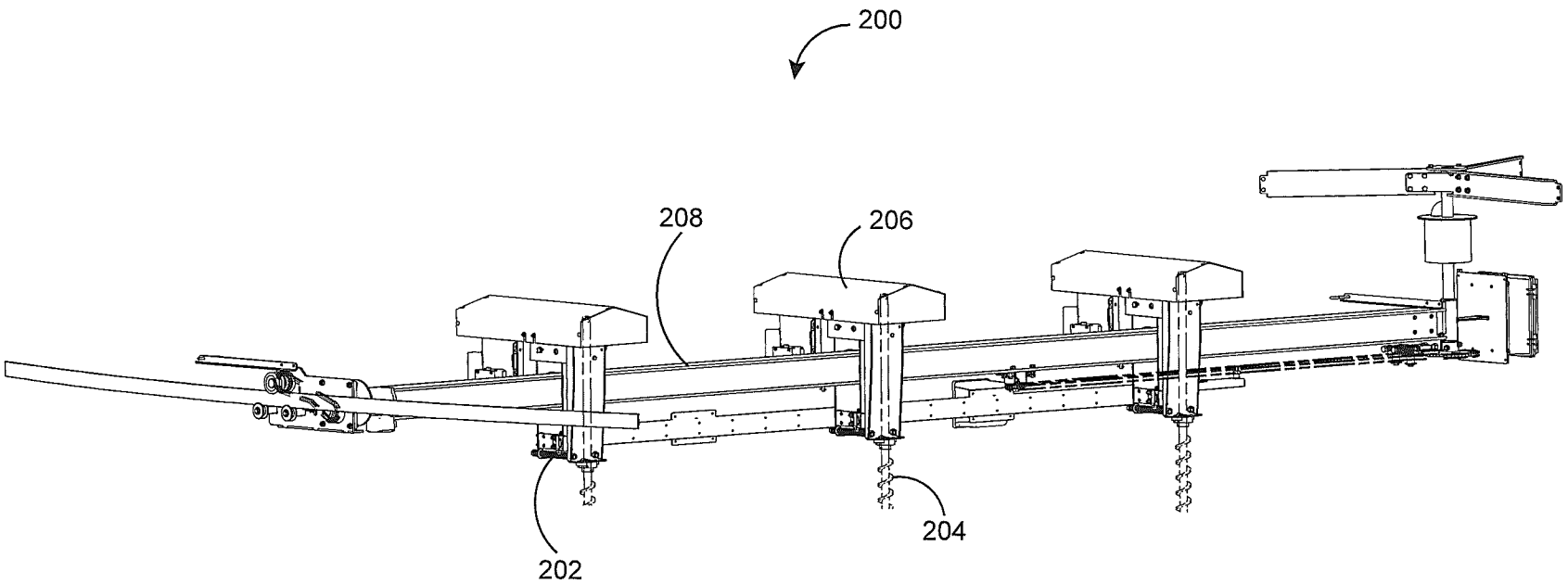
FIG. 2 is a schematic diagram of an auger protecting system for a stirring machine showing a plurality of augers in accordance with a further preferred embodiment of the present invention.

FIG. 2 is a schematic diagram of an auger protecting system 200 for a stirring machine showing a plurality of augers in accordance with a further preferred embodiment of the present invention. As shown, the plurality of down augers 204 are connected to a plurality of securing structures 206 which extend downwards to a grain storage bin and are attached to a beam 208. The plurality of switches 202 are connected to a timer which supplies power to the gear motor that propels the unit around the silo. Preferably, the plurality of switches 202 are configured to be actuated and to shut off the gear motor when any one of the corresponding down augers 204 compress the spring to a maximum allowable distance. This shutting off of the gear motor preferably allows the plurality of down augers 204 to catch up in the grain and results in more effectively moving and stirring grain in the grain storage bin.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An auger protection system for use with a stirring machine having a down auger, an upper structure, and a motor for supplying power to the down auger, wherein the auger protection system comprises:

a pivot assembly, wherein the pivot assembly is attached at one end to the upper structure, further wherein the pivot assembly further comprises a switch housing;

a switch, wherein the switch is enclosed in the switch housing, further wherein the switch is operatively connected to the motor; and a spring, wherein the spring is connected at a first end to the pivot assembly and at a second end to the down auger, wherein the spring is configured to measure the lateral displacement of the down auger; further wherein the spring is configured to actuate the switch when the spring is stretched or compressed beyond a predetermined maximum distance indicating a maximum allowable spring tension.

2. The auger protection system of claim 1, wherein reaching or exceeding a maximum allowable spring tension triggers a change in the power supplied by the motor.

3. The system of claim 2, wherein reaching or exceeding a maximum allowable spring tension causes the motor to turn off.

4. The auger protection system of claim 3, wherein reaching or exceeding a maximum allowable spring tension triggers a reduction in the power supplied by the motor.

5. The auger protection system of claim 4, wherein the motor is automatically turned on after the spring tension is reduced.

6. The auger protection system of claim 2, wherein the motor is shut off at periodically determined intervals based on recording predetermined maximum allowable spring tensions over a sample period of time.

* * * * *